United States Patent [19]

Pharo

[11] Patent Number: 4,918,904

[45] Date of Patent: Apr. 24, 1990

[54] METHOD FOR FORMING CLAM-LIKE PACKAGING SYSTEM

[76] Inventor: Daniel A. Pharo, 1901 Avenue of the Stars, Suite 450, Los Angeles, Calif. 90067

[21] Appl. No.: 392,431

[22] Filed: Aug. 11, 1989

Related U.S. Application Data

[60] Division of Ser. No. 262,537, Oct. 25, 1988, Pat. No. 4,874,093, which is a continuation-in-part of Ser. No. 89,228, Aug. 25, 1982, Pat. No. 4,872,558.

[51] Int. Cl.[5] ..... B65B 23/22

[52] U.S. Cl. ..... 53/472; 53/449; 493/931

[58] Field of Search ..... 53/449, 472, 469, 467, 53/457; 493/931, 920, 929, 213

[56] References Cited

U.S. PATENT DOCUMENTS

| | | | |
|---|---|---|---|
| 3,340,669 | 9/1967 | Farquharson | 53/472 X |
| 4,267,684 | 5/1981 | Ambrose | 53/472 |
| 4,597,244 | 7/1986 | Pharo | 53/434 |
| 4,653,250 | 3/1987 | Nakamura | 493/931 X |

FOREIGN PATENT DOCUMENTS

| | | | |
|---|---|---|---|
| 1360924 | 7/1974 | United Kingdom | 53/472 |

*Primary Examiner*—James F. Coan

*Attorney, Agent, or Firm*—Phillips, Moore, Lempio & Finley

[57] ABSTRACT

A packaging system comprises a first bag portion defining an inflated first chamber and a second bag portion defining an inflated second chamber with the bag portions overlying each other to define a pocket therebetween having an article compressed and retained therein. The bag portions are pivotally connected together at a rearward side of the system and overlying edge portions of the bag portions are heat-sealed together at opposite lateral sides of the packaging system. The frontal side of the packaging system is open to permit insertion of the article into the pocket whereafter the packaging system is preferably inflated with a pressurized fluid, such as air, to compress superimposed panels of the bag portions against the article to retain it within the pocket.

6 Claims, 2 Drawing Sheets

METHOD FOR FORMING CLAM-LIKE PACKAGING SYSTEM

CROSS-REFERENCE TO RELATED APPLICATION

This application is a Divisional of U.S. patent application Ser. No. 07/262,537 filed on Oct. 25, 1988 for "CLAM-LIKE PACKAGING SYSTEM" now U.S. Pat. No. 4,874,093 which in turn, is a Continuation-in-Part of U.S. patent application Ser. No. 89,228, filed on Aug. 25, 1987, now U.S. Pat. No. 4,872,558 by Daniel A. Pharo for "Bag-In-Bag Packaging System and Method."

TECHNICAL FIELD

This invention relates generally to a packaging system and method and more particularly to an inflatable package having a clam-like configuration adapted to compress and retain an article therein.

BACKGROUND ART

U.S. Pat. No. 4,597,244, issued on July 1, 1986 to Daniel A. Pharo for "Method for Forming An Inflated Wrapping," discloses a packaging system and method wherein an article is packaged within an inflated, sealed bag. The present invention provides certain improvements and variations over the packaging system and method taught in the above patent.

DISCLOSURE OF INVENTION

The improved packaging system of this invention comprises overlying first and second bag portions pivotally connected together at a rearward side of the packaging system. Overlying edge portions of the bag portions are secured together at opposite lateral sides of the packaging system with the bag portions remaining unattached to each other at a frontal side of the packaging system to expose the pocket therebetween. Inflating means are preferably provided on the packaging system to at least partially fill the bag portions with a filler medium, such as pressurized air, to compress the bag portions against an article retained in the pocket.

In carrying forth the method of this invention, a package is first formed to define at least one chamber therein adapted to contain the filler medium, the package is folded to form superimpose the bag portions, and lateral sides of the bag portions are secured together to define the pocket for subsequent retention of the article therein.

BRIEF DESCRIPTION OF THE DRAWINGS

Other objects and advantages of this invention will become apparent from the following description and accompany drawings wherein.

BEST MODE OF CARRYING OUT THE INVENTION

Figure 1:
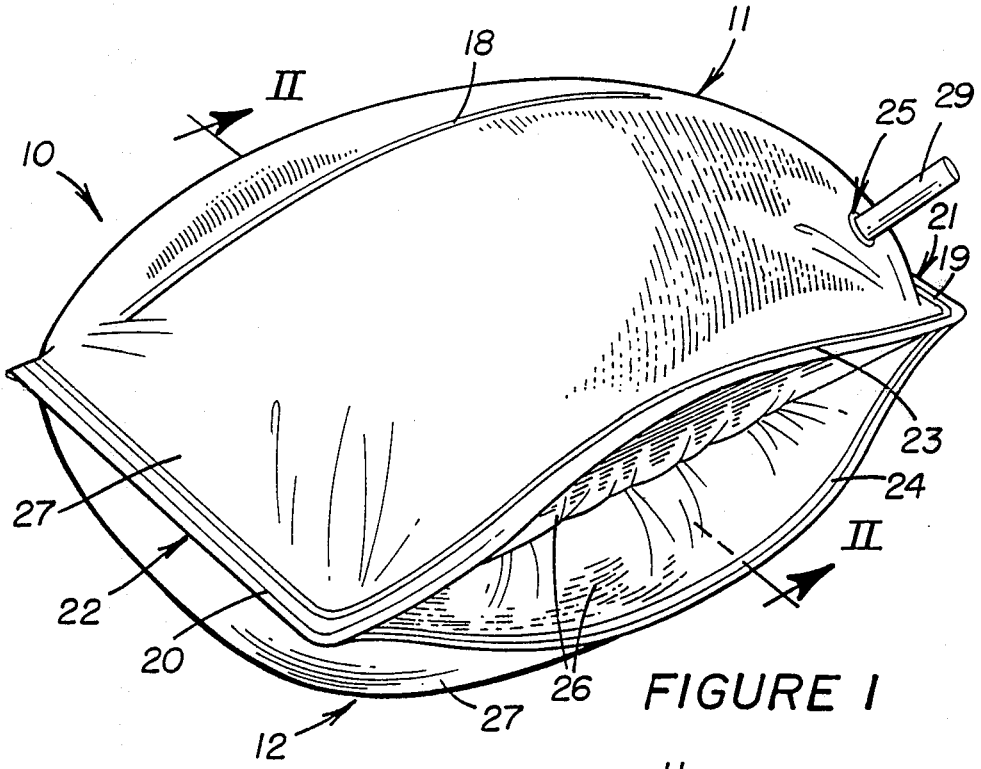
FIG. 1 is an isometric view illustrating a frontal side of a packaging system embodying this invention.
Figure 2:
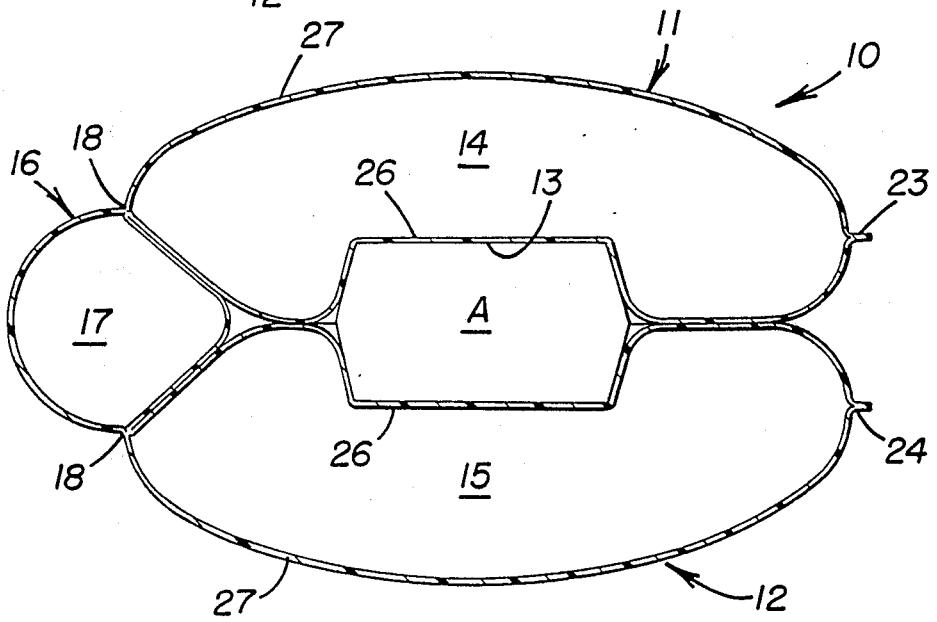
FIG. 2 is a longitudinal sectional view through the packaging system, taken in the direction of arrows II—II in FIG. 1.

FIGS. 1 and 2 illustrate a packaging system 10 comprising an upper or first bag portion 11 overlying a lower or second bag portion 12 to define a pocket 13 therebetween. Bag portions 11 and 12 define expandable and inflatable chambers 14 and 15 therein, respectively, whereby an article A is compressed between the bag portions to retain it in a fixed position within the packaging system. An intermediate or third bag portion 16 is pivoted on either side thereof to the first and second bag portions at heat-sealed seams 18 to thus provide hinge means pivotally connecting the bag portions together at a rearward side of the packaging system. The opposite lateral sides of the packaging system are closed by overlying side edge portions 19 and 20 (FIG. 3) of the bag portions that are sealed together to form side seams 21 and 22, respectively. End edge portions 23 and 24 remain unattached to each other at the frontal side of the packaging system to expose pocket 13 which is adapted to receive article A therein when the packaging system is at least partially deflated. Inflating means, shown in the form of a valve 25 such as that disclosed in U.S. Pat. No. 4,586,910, is shown secured on bag portion 11 to selectively communicate a filler medium to intercommunicating chambers 14 and 15, as described more fully hereinafter.

Figure 3:
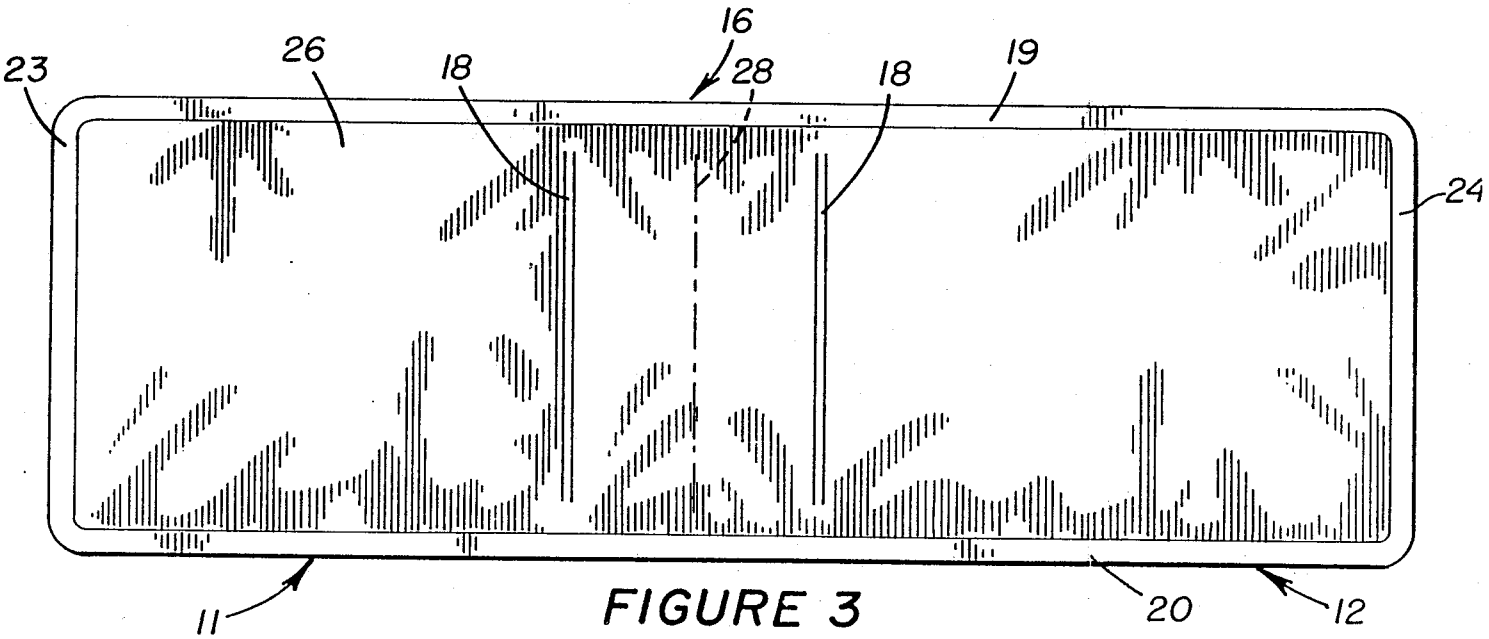
FIG. 3 is a top plan view of a pre-fabricated package adapted to be formed into the packaging system.
Figure 4:
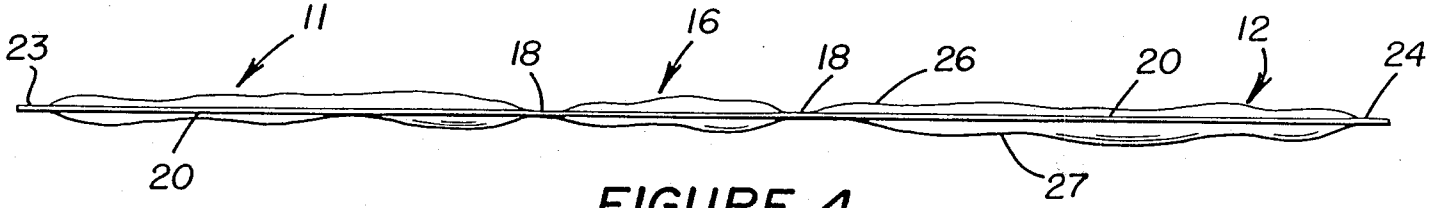
FIG. 4 is a side elevational view of the package.

FIGS. 3 and 4 illustrate a pre-fabricated package adapted to form packaging system 10. The package comprises a pair of superimposed, generally rectangular and coextensive panels 26 and 27 heat-sealed together at longitudinally spaced and parallel seams 18, formed transversely across the panels and between longitudinally spaced ends thereof. The seams, as shown in FIG. 3, each terminate short of side edge portions 19 and 20 of the package. This arrangement thus provides passages between overlying portions of panel 26, intercommunicating chambers 14, 15 and 17 when the package is formed by side seams 21 and 22 into packaging system 10 (FIGS. 1 and 2).

It should be understood that additional seams of this type could be utilized or a single seam, formed intermediate the ends of the package as illustrated by dot-dash line 28 in FIG. 3, could be utilized to provide various hinge connections at the rearward side of the packaging system.

Panels 26 and 27 can be preformed as separate sheets that are heat-sealed together, entirely about the peripheries of the panels, to form side edge portions or seams 19 and 20 and end edge portions or seams 23 and 24. Alternatively, a single sheet of material can be folded laterally over itself and a single seam 19 or 20, along with the end seams. Also, the package can be formed from a seamless tube of material (eliminating both seams 19 and 20) heat-sealed at end seams 23 and 24.

The sheet material composing the package may comprise a gas-impervious composite laminate, such as the type described in U.S. Pat. No. 4,597,244. For example, each flexible panel comprising the package may be composed of an intermediate layer of aluminum and outer and inner layers of a plastic heat-sealable coating, such as polyethylene, adapted to reactivate (melt) in the range of 300 F. These types of composite laminates (which may be constructed to be highly flexible and inextensible or extensible) are well known in the art, and, therefore, further description thereof is unnecessary for a full understanding of this invention. Further, the panels may be suitably cut and sealed together by conventional apparatus and methods, such as those described in U.S. Pat. No. 4,545,844.

Once the package illustrated in FIGS. 3 and 4 has been prefabricated, the package is folded to superimpose bag portion 11 over bag portion 12, as illustrated in FIG. 2. Overlying side edge portions 19 are then heat-sealed (or mechanically secured together by a standard adhesive, stitching, etc.) and opposite side edge portions 20 are also secured together in this manner to form side seams 21 and 22, respectively. The deflated package is thus adapted to have article A (FIG. 2) inserted through the open frontal side of the packaging system and into pocket 13.

After the article has been inserted, a standard inflation apparatus, including a fill tube 29 (FIG. 1), can be utilized to charge and pressurize intercommunicating chambers 14, 15 and 17 to an inflation pressure exceeding ambient pressure, e.g., exceeding 14.7 psi at sea level. Alternatively, human lung power could be utilized to inflate the chambers with air.

Other types of gases, such as helium, could be utilized as a filler medium, as well as a suitable liquid, such as water. Alternatively or in addition to pressurized fluid, the chamber could be filled with a plastic material (e.g., urethane, polystyrene, etc.) material in solid (injected in liquid form and solidified) or pieces (e.g., balls or pellets) form.

Should it prove desirable to fill the chambers with a solid filler medium to the type described above, it may prove desirable to pre-pack such filler medium into the chambers prior to forming one or more of edge portions or seams 19, 20, 23 and 24 or to provide a separate inflating means or valve for communicating the filler medium to each chamber individually. In such an application, each seam 18 could be extended the full width of the package (FIG. 3) to place the chambers out of communication in respect to each other. Other modifications can be made to the package and completed packaging system of this invention without departing from the spirit and scope thereof, as will be apparent to those skilled in the arts relating hereto.

We claim:

1. A method for forming a packaging system comprising the steps of forming a package to define a first bag portion superimposed over a second bag portion thereof with each of said first and second bag portions defining an inflatable chamber therein, including forming at least one seam transversely across said first and second bag portions to define at least one passage between said first and second bag portions intercommunicating the inflatable chambers thereof, securing overlying side edge portions of said bag portions together at opposite lateral sides thereof to define an article-retaining pocket therebetween and to expose said pocket on only one side of said package.

2. The method of claim 1 wherein said forming step comprises forming said package from overlying inner and outer pairs of superimposed panels with each of said inner panels forming a said inflatable chamber with a respective and overlying one of said outer panels.

3. The method of claim 2 further comprising at least substantially filling each said chamber with a filler medium.

4. The method of claim 1 wherein said forming step includes forming a single seam transversely across said first and second bag portions.

5. The method of claim 1 wherein said forming step comprises forming a pair of said seams in longitudinally spaced relationship transversely across said first and second bag portions.

6. The method of claim 1 further comprising securing inflating means to at least one of said first and second bag portions for filling each said chamber with a filler medium.

* * * * *